US010072430B2

(12) United States Patent
Nasibov

(10) Patent No.: US 10,072,430 B2
(45) Date of Patent: Sep. 11, 2018

(54) CLIMATE CONTROLLED WATERSIDE ENCLOSURE

(71) Applicant: Emin Nasibov, Nizami/Baku (AZ)

(72) Inventor: Emin Nasibov, Nizami/Baku (AZ)

( * ) Notice: Subject to any disclaimer, the term of this patent is extended or adjusted under 35 U.S.C. 154(b) by 0 days.

(21) Appl. No.: 14/976,916

(22) Filed: Dec. 21, 2015

(65) Prior Publication Data

US 2016/0177586 A1 Jun. 23, 2016

(30) Foreign Application Priority Data

Dec. 22, 2014 (GB) ..... 1422954.6

(51) Int. Cl.
*E04H 3/02* (2006.01)
*E04H 3/16* (2006.01)
(Continued)

(52) U.S. Cl.
CPC ..... *E04H 3/02* (2013.01); *E02B 8/06* (2013.01); *E02D 27/12* (2013.01); *E02D 27/50* (2013.01);
(Continued)

(58) Field of Classification Search
CPC .... E04H 3/02; E04H 3/16; E04H 4/00; E04H 4/1209; E04B 1/32; E04B 1/342;
(Continued)

(56) References Cited

U.S. PATENT DOCUMENTS 1,223,515 A * 4/1917 Papanastasiou ..... F24F 7/007 114/334
3,240,186 A * 3/1966 Dobell ..... A01K 61/007 114/66
(Continued)

FOREIGN PATENT DOCUMENTS

CN 201865374 U * 6/2011
CN 103643810 A 12/2013
(Continued)

OTHER PUBLICATIONS

Machine translation of foreign reference CN 201865374U, obtained from http://dialog.proquest.com/professional/patents/docview/1362436914/157639B05E84229FF03/2?accountid=161361 (last accessed on Oct. 26, 2016).*
Patents Act 1977: Search Report Under Section 17; UK Intellectual Property Office; Great Britain Patent Application No. GB1422954.6; dated Feb. 26, 2015; 1 page.
European Search Report; European Patent Office; European Patent Application No. 15161386.6; dated Jul. 9, 2015; 6 pages.
(Continued)

*Primary Examiner* — Theodore V Adamos
(74) *Attorney, Agent, or Firm* — Taft Stettinius & Hollister LLP

(57) ABSTRACT

A waterside leisure facility is disclosed which comprises an enclosure, covering and surrounding an area of land mass, an enclosed portion of a larger body of water, the land mass having a shore front adjoined to the portion of the body of water, the enclosure further comprising a dividing wall separating the enclosed portion of water from the remaining body of water a transparent roof, joined to the dividing wall and surrounding the area of land mass, to substantially separate air in the enclosure from ambient air outside the enclosure, while letting light through the roof, water treatment means arranged to maintain the water in the enclosure at a controlled temperature, while circulating water from outside the enclosure through the enclosure; and air conditioning means arranged to maintain the ambient air inside the enclosure at a controlled temperature and/or humidity.

23 Claims, 7 Drawing Sheets

(51) Int. Cl.

| | |
|---|---|
| ***E04H 4/00*** | (2006.01) |
| ***E04H 4/12*** | (2006.01) |
| ***E02B 8/06*** | (2006.01) |
| ***E02D 27/12*** | (2006.01) |
| ***E02D 27/50*** | (2006.01) |
| ***E02D 27/52*** | (2006.01) |
| ***E04B 1/32*** | (2006.01) |
| ***E04B 1/342*** | (2006.01) |
| ***F24F 5/00*** | (2006.01) |

(52) U.S. Cl.
CPC ..... *E02D 27/525* (2013.01); *E04B 1/32* (2013.01); *E04B 1/342* (2013.01); *E04H 3/16* (2013.01); *E04H 4/00* (2013.01); *F24F 5/0046* (2013.01); *F24F 5/0071* (2013.01); *E04H 4/1209* (2013.01)

(58) Field of Classification Search
CPC .. E02D 7/12; E02D 7/50; E02D 7/525; E02D 27/12; E02D 27/50; E02D 27/525; F24F 5/0046; F24F 5/0071; E02B 8/06
USPC ..... 52/169.1, 169.2, 169.3, 169.11; 472/128; 119/200–244
See application file for complete search history.

(56) References Cited

U.S. PATENT DOCUMENTS 3,629,877 A * 12/1971 Schuster ..... E04H 4/0006 4/491
3,701,224 A * 10/1972 Mozier ..... E04H 3/02 52/27
3,998,186 A * 12/1976 Hodges ..... A01K 61/59 119/207
4,186,532 A * 2/1980 Kahn ..... B63B 35/44 114/314
4,201,495 A 5/1980 Preus
4,837,989 A * 6/1989 Levy ..... A01K 63/003 119/174
4,904,118 A * 2/1990 Thiemann, III ..... B63B 35/44 405/194
4,905,326 A * 3/1990 Nakamura ..... E04H 3/16 4/488
4,958,465 A * 9/1990 Levy ..... A01K 61/00 52/169.1
5,216,976 A * 6/1993 Marinkovich ..... A01K 61/00 119/200
5,603,189 A * 2/1997 Levy ..... E04H 3/06 119/245
6,019,547 A * 2/2000 Hill ..... A63G 31/007 4/491
6,128,863 A * 10/2000 Millay ..... E04H 3/06 114/314
6,325,012 B1 * 12/2001 Aristizabal ..... B63C 11/34 114/314
7,036,449 B2 * 5/2006 Sutter ..... B63B 35/44 114/264
2003/0014927 A1 * 1/2003 Brooks ..... E04B 1/0046 52/66
2008/0143896 A1 * 6/2008 Yurth ..... E06B 9/24 349/16
2015/0125212 A1 * 5/2015 Fischmann ..... E04H 4/0012 405/63

FOREIGN PATENT DOCUMENTS

| | | | |
|---|---|---|---|
| CN | 103643810 | A | 3/2014 |
| FR | 776441 | A | 1/1935 |
| FR | 2814431 | A1 | 3/2002 |
| FR | 2977267 | A1 | 1/2013 |
| GB | 274461 | A | 1/1928 |
| GB | 2409408 | A | 6/2005 |
| JP | 08189216 | A | 7/1996 |
| RU | 69091 | U1 | 12/2007 |
| RU | 111550 | U1 | 12/2011 |
| WO | 99/55147 | A1 | 11/1999 |
| WO | 2009/105119 | A1 | 8/2009 |

OTHER PUBLICATIONS

Search Report; National Centre of the Intellectual Property "Sakpatenti" of Georgia; Georgian Patent Application No. AP 2016 014259; Jan. 10, 2018; 2 pages.

* cited by examiner

CLIMATE CONTROLLED WATERSIDE ENCLOSURE

CROSS REFERENCE TO RELATED APPLICATIONS

This application claims priority to United Kingdom Patent Application No. 1422954.6 filed on Dec. 22, 2014, the contents of which are incorporated herein in their entirety.

FIELD OF THE INVENTION

The present invention relates to waterside leisure facilities. In particular, the invention relates to an enclosed waterside leisure facility in which environmental factors are controlled to increase utilisation of the area throughout seasonal variations in weather conditions.

BACKGROUND OF THE INVENTION

Waterside leisure facilities are well known and come in many forms. Hotels, beachside facilities, leisure parks, theme parks and apartment complexes are built in waterside locations because users enjoy the combination of countryside and waterside settings and the range of activities and entertainments which can be enjoyed on land and on the water. Such complexes exist on riverside, lakeside and seaside locations. However, the vast majority of complexes in the world are located in areas whose usage is significantly affected by changes in climate as the seasons change. Generally, resorts which are located directly on the equator or near to it are not necessarily easily accessible by local communications links, such as airports, railways and roads. Further, since they are often in very hot environments all year round, they are not necessarily ideally suited to use for all leisure purposes. Even where facilities are available in locations which have a good climate for general use all year round, the number of available locations is limited and not necessarily usefully accessible by users from all parts of the world.

Where waterside leisure facilities are located in areas where the environmental conditions are affected by seasons, there is often a relatively short peak season where the facilities are useful, since the ideal combination of water temperature, land temperature and air temperature and humidity only occurs at certain points in the year. This causes technical and logistical problems, since the facilities may be only used for part of the year, which means that the transportation related problems of getting seasonal staff to and from the location can render operations inefficient, and many of the leisure facilities or equipment may have to be stored in safe locations during autumn, winter and spring months and only brought out during summer, which causes further technical problems in terms of storage, security, maintenance and user familiarity with the equipment being used, as well as resulting in sub-optimal utilisation of the equipment around the year.

The seasonality associated with the vast majority of waterside leisure facilities therefore has a number of drawbacks.

SUMMARY OF THE INVENTION

The present invention seeks to address the drawbacks associated with the seasonality of the environmental conditions which permit or prevent leisure facilities from being used to their best effect during all periods of the year.

According to the present invention, there is provided a waterside leisure facility comprising:

- an enclosure, covering and surrounding:
  - an area of land mass sized to accommodate a group of users of the facility;
  - an enclosed portion of a larger body of water, the enclosed portion sized to accommodate a group of users of the facility;
  - the land mass having a shore front adjoined to the portion of the body of water;
- the enclosure further comprising:
  - a dividing wall separating the enclosed portion of water from the remaining body of water;
  - a transparent roof, joined to the dividing wall and surrounding the area of land mass, to substantially separate air in the enclosure from ambient air outside the enclosure, while letting light through the roof;
  - water treatment means arranged to maintain the water in the enclosure at a controlled temperature; and
  - air conditioning means arranged to maintain the ambient air inside the enclosure at a controlled temperature and humidity.

The facility of the invention therefore creates a controlled environment which encloses a portion of a large body of water, and a portion of the land mass adjoining the water, so that users can enjoy the experience of a water-side location, joined by the views and surroundings associated with a large land mass and a large body of water, while the conditions of the environment in the portion of the body of water enclosed in the enclosure can be controlled and regulated to provide an optimum environment for users to enjoy the land and the water and any available leisure facilities. The water treatment means may in certain embodiments circulate water from outside the enclosure through the enclosure. The enclosure of the invention serves to both emulate and incorporate aspects of the outside environment within the enclosure, such as natural water from the large body of water. Therefore, rather than creating a false environment within the enclosure, the facility of the invention creates a more natural feeling space, using available resources from the surroundings rather than a wholly emulated indoor environment which is entirely separated from the surroundings.

The facility may comprise wave control means for controlling the wave state of the water in the enclosure. This may take the form of a wave machine separate from the main body of water or may include means for permitting but limiting wave motion allowed into the enclosure from the main body of water into the enclosed portion of water.

The facility may further comprise wind control means for controlling wind conditions in the enclosure. This may take the form of fans or blowers for creating wind in the enclosure to emulate a breeze, or it may include openable portions in the walls or roof of the enclosure, to permit air from outside the enclosure to circulate within the enclosure.

At least a part of the roof may comprise transparency control means for controlling the transparency of the roof so that more or less light can be allowed to enter the enclosure. This can be in the form of shutters, blinds, or actively tintable glass or other materials which can control the passage of light through a pane of glass.

The facility may comprise an accommodation block comprising accommodation for a group of users. This can allow users to use, enter and leave the accommodation block as if it is located outside when the outside is in reality the enclosure which has a controlled environment. The accommodation block may comprise sleeping eating and sanitary facilities for the users, preferably in separate living and sleeping spaces for each user or groups of users, such as are found in hotel accommodation.

The dividing wall may comprise at least a portion of the water treatment means. This can allow a short path for water between the main body and the enclosed portion.

The roof may be supported at a land side by a foundation provided in the land mass and at a second side by a foundation provided in the bed of the body of water. This allows a permanent structure to be provided enclosing the enclosed portion of land and the enclosed water, to securely enclose and keep the contents protected from the external environment.

The foundation at the land side may be a foundation of a building. This enables the enclosure to be efficiently combined with a building on the land mass above the shoreline.

The foundation at the water side may be a foundation for the dividing wall and/or separate columns, depending on requirements determined during engineering design and calculations. This allows the roof and dividing wall to be supported on a common foundation.

The enclosed portion of water may be enclosed by a bottom wall portion which extends from the bed of the body of water to the dividing wall to provide an enclosed portion of water of controlled depth.

The bottom wall portion and/or the dividing wall may be supported by one or more foundations embedded in the bed of the body of water. The bottom wall portion can thus be efficiently supported on common foundations with the remaining structure and supported at a distance from the bed of the body of water.

One or more of the dividing wall and/or the bottom wall portion may comprise at least one compliant portion for allowing wave energy to pass through the dividing wall or floor of the enclosure.

The dividing wall(s) may comprise additional material layers to achieve desired design and engineering characteristics.

The enclosure may enclose one or more of: an accommodation unit for providing living accommodation to a number of users; a catering facility for providing catering to a number of users.

The enclosure may comprise a plurality of sub-sections, connected via one or more reclosable openings, doorways or corridors. The sub-sections may comprise differing shapes, dimensions or volumes, provided to fulfil different user functions. The may comprise a plurality of adjoining sub-sections. The sub-sections may have different sizes and/or dimensions from one another, for providing different or same user functions. One or more of the sub-sections may be configured to have a different controlled environmental condition from an adjoining sub-section. The environmental condition may be one or more of a temperature of the water, and/or a temperature or humidity of the air in the enclosure subsection.

BRIEF DESCRIPTION OF THE DRAWINGS

Alternative embodiments of the invention will now be described with reference to the following figures, in which.

DETAILED DESCRIPTION OF EMBODIMENT(S)

Figure 1A:
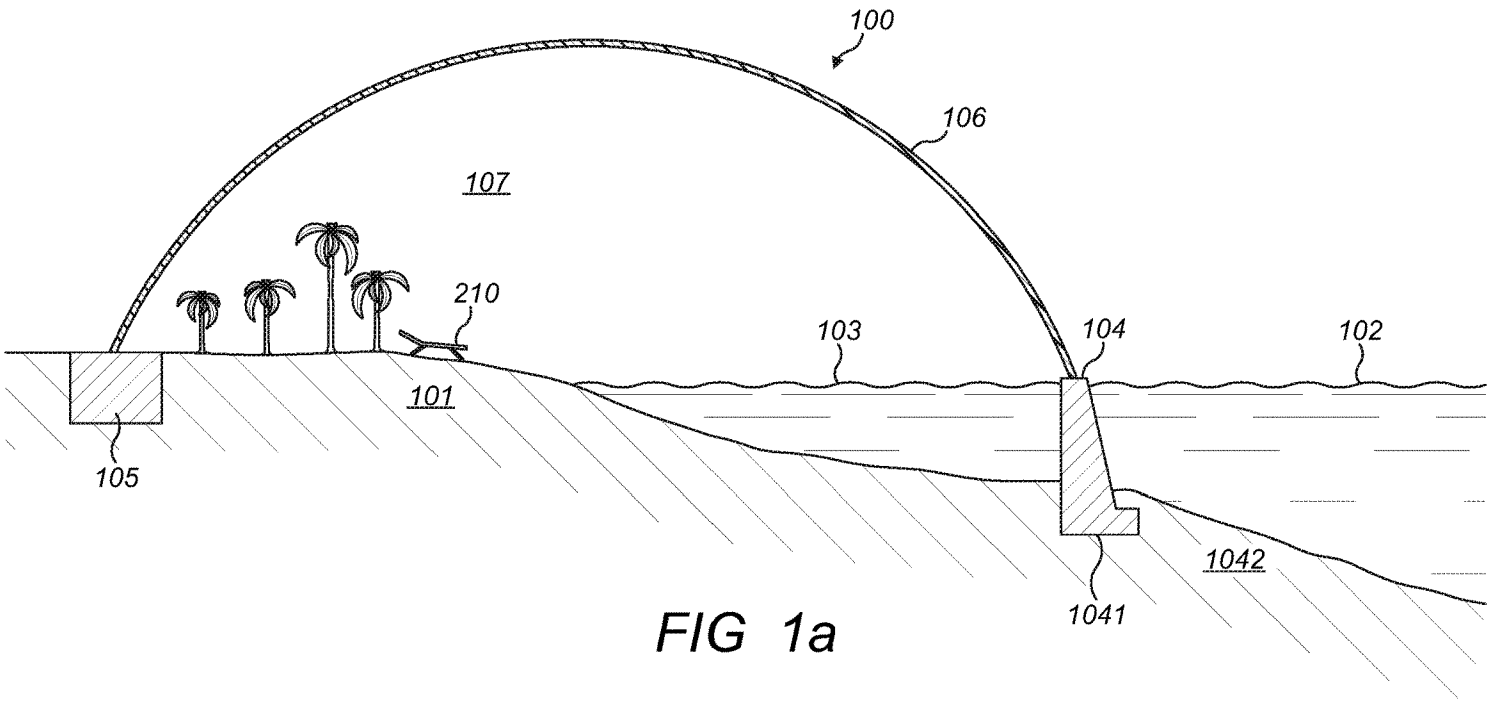
FIGS. 1*a* and 1*b* illustrate a first example of an enclosure according to the invention.

FIG. 1 shows a first enclosure 100 of the invention. The enclosure 100 encloses a portion of a land mass 101 and a portion 103 of a body of water 102. The portion 103 of the body of water is enclosed within a wall 104. Wall 104 has a foundation 1041 embedded in the bed 1042 of the body of water 102, be it a seabed, a lake bed, or a river bed. A second foundation 105 is located on the land mass 1012. These foundations act together to support a roof 106 which covers the entirety of the enclosure, including a portion of the land mass 101 and the portion 103 of the body of water 102. This enables the user of the enclosure 100 to enjoy the natural surroundings of the body of water 102, and the remainder of the land mass 101 through the preferably transparent roof 106. However, the configuration of the wall 104 and the roof 106 means that the entire environment at the shore of the body of water 102 can be controlled for the enjoyment of users inside the enclosure 100.

The isolated portion 103 of the body of water 102 can be heated, cooled, filtered, recirculated and/or optionally replaced or replenished with water from the overall body of water 102. This means that regardless of temperature of the main body of water 102, the isolated portion can be maintained at a comfortable temperature for users of the enclosure during any season of the year. In certain locations, the sea can be uncomfortably warm for swimming and so a cooling system can be provided to cool the water to a comfortable temperature. Conversely, in areas which are exposed to cooler temperatures during autumn, winter and spring months, the isolated portion 103 can be heated to provide a comfortable environment for users of the water. Wall 104 may be opaque or transparent as required. The enclosed area of the land mass 101 provides a waterside location for users to enjoy the isolated body of water 103 in a controlled environment.

Air conditioning systems can be provided to control the temperature of air 107 within the enclosure and its humidity may also be controlled by suitable air temperature and humidity control means.

The regulated environment enables the enclosed portion 103 of the body of water and the shore side of the land mass 101 to be enjoyed throughout the year regardless of seasonal variations of the ambient temperature and general weather conditions outside the enclosure 100. When large winds are experienced, the body of water 102 may be subject to rough conditions, and so waves and general storms can be isolated from the users of the enclosure by the wall 104 to provide better protection from dangerous waterside conditions in extreme weather. This also improves the usability of the portions of land 101 and water 103 within the enclosure.

Figure 1B:
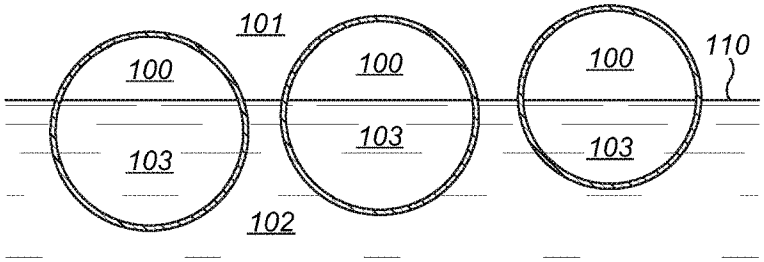

FIG. 1*b* shows a plan view of alternative arrangements of the enclosure 100 relative to a shore line 110 separating the above water-level portion of the land mass 101 from the body of water 102. As can be seen, the outer perimeter of the enclosure 100 may be located so that a majority of the enclosure covers a portion 103 of the body of water, or alternatively, it may be positioned so that a majority of the enclosure is over the land mass 101, or so that equal amounts of surface area of water 103 and land mass 101 are covered.

Figure 2A:
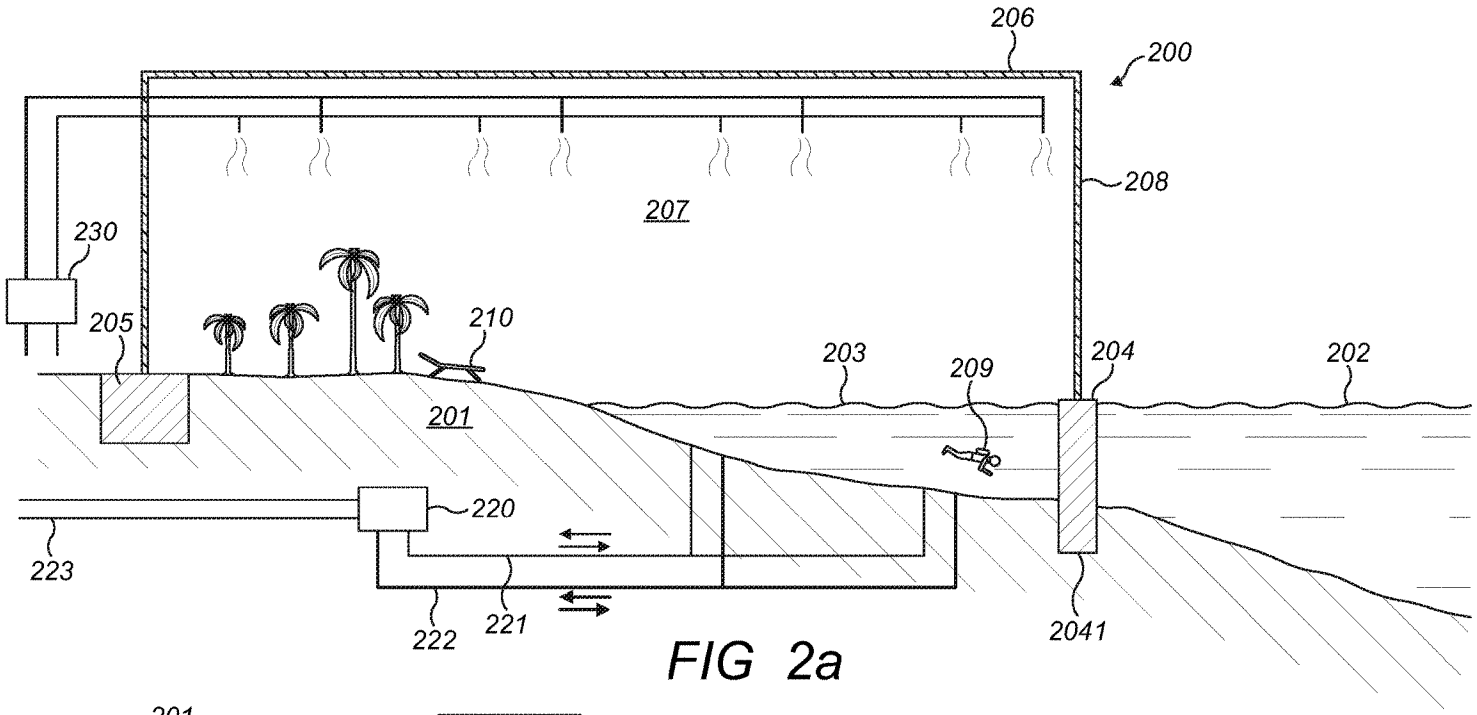
FIGS. 2*a* and 2*b* illustrate a second example of an enclosure according to the invention.

FIG. 2*a* shows an alternative arrangement of an enclosure 200 of the present invention. Again, the enclosure comprises a land mass 201 and a portion 203 of a body of water 202. A substantially straight wall 204 separates the body of water 202 from the isolated portion 203. The enclosure has substantially straight side walls 208, a substantially planar roof 206 and substantially straight walls and foundations 204 and 205.

As can also be provided for the example illustrated in FIG. 1*a*, water treatment means 220, located on land or in the wall 204, can be provided with water delivery pipes 221 and 222 for delivering either hot or cold treated water to and from the isolated portion 203 of the body of water 202. This allows the water to be kept fresh and clean for the users, while they have the sensation of swimming or generally occupying the larger body of water 202. Power may be delivered to the water treatment means 220 by power cables 223.

Similarly, an air conditioning unit 230 can be provided to deliver hot or cold air to and from the ambient air 207 of the enclosure 200 to provide a controlled temperature and humidity within the enclosure 200.

Figure 2B:
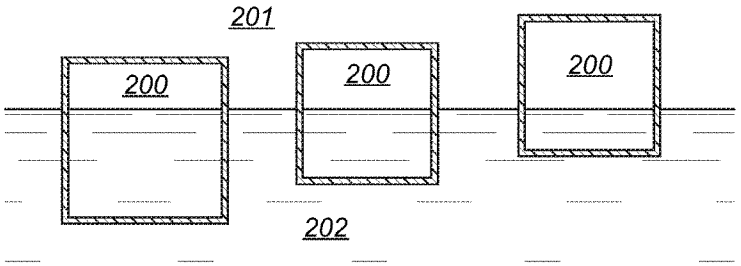

FIG. 2*b* again shows different configurations for an enclosure 200 can be arranged to have greater or lesser proportions of the land mass 201 and the body of water 202 contained within its perimeter.

Figure 3A:
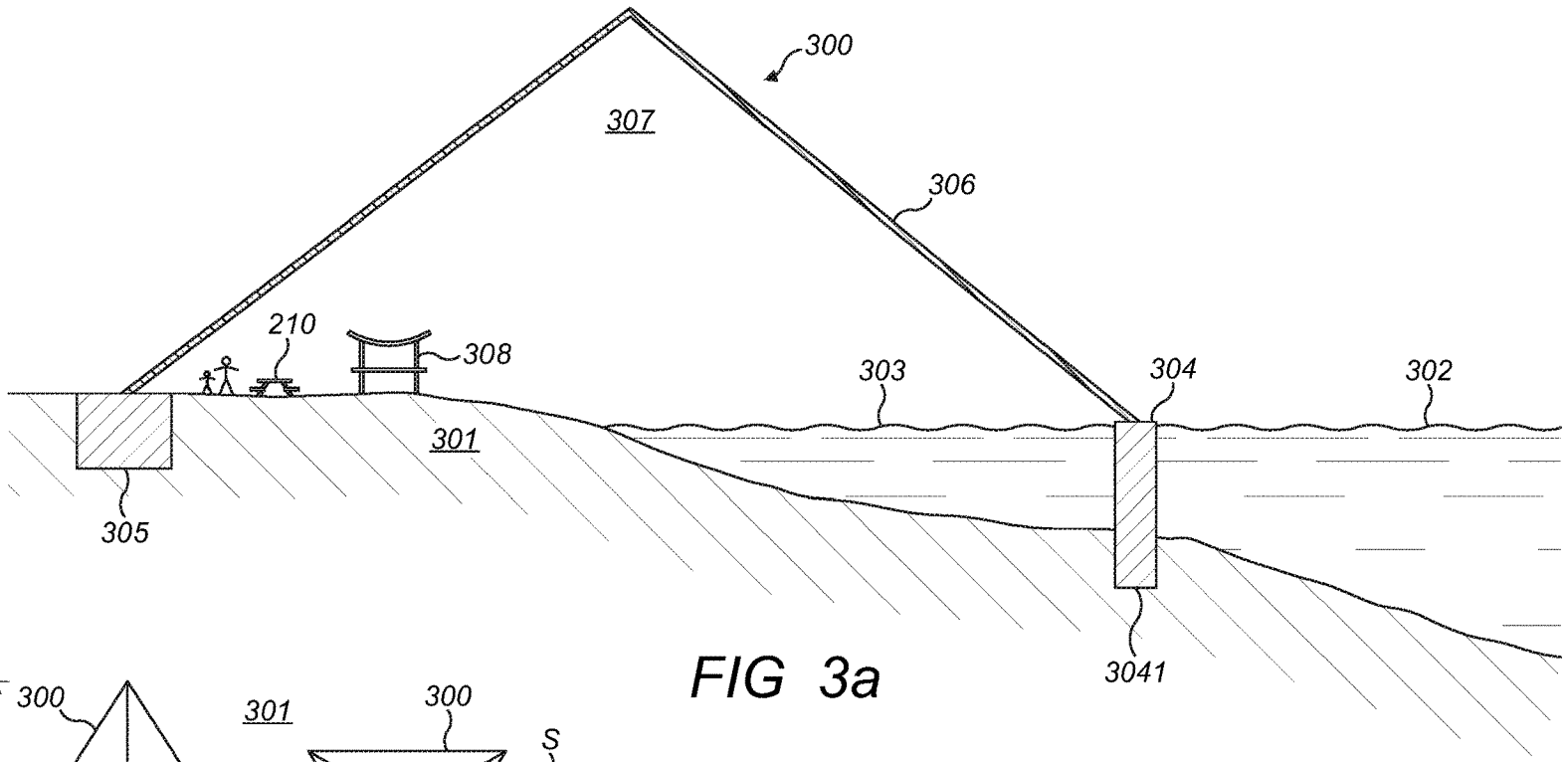
FIGS. 3*a* and 3*b* show a third example of an enclosure accordingly to the invention.
Figure 3B:
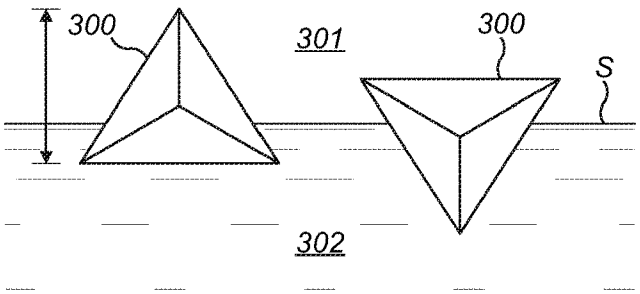

FIGS. 3*a* and 3*b* similarly illustrate an arrangement of the enclosure 300 which is constructed from substantially parallel walls 304 with straight foundations 3041 and 305, this time arranged in a substantially straight configuration with triangular roof sections 306. The triangular base can be arranged with a greater proportion, or a lesser proportion of the land mass 301 or the body of water 302 within the enclosure 300. A triangular form allows a larger proportion of surface area of water to be accommodated within the enclosure for a set length l of the enclosure measured substantially perpendicularly to the shore line S.

The enclosure of any of the embodiments illustrated herein can be of any general size, but should generally be large enough to accommodate comfortably a number of persons both on the land mass 301 and in the enclosed portion of the body of water, such as portion 303. The length of the enclosure generally can vary and depends on number of persons to accommodate. The height should generally be large enough to give a feeling of a substantially outdoor space, and so the ceilings should be generally of a height chosen depending on design and engineering calculations.

Figure 4:
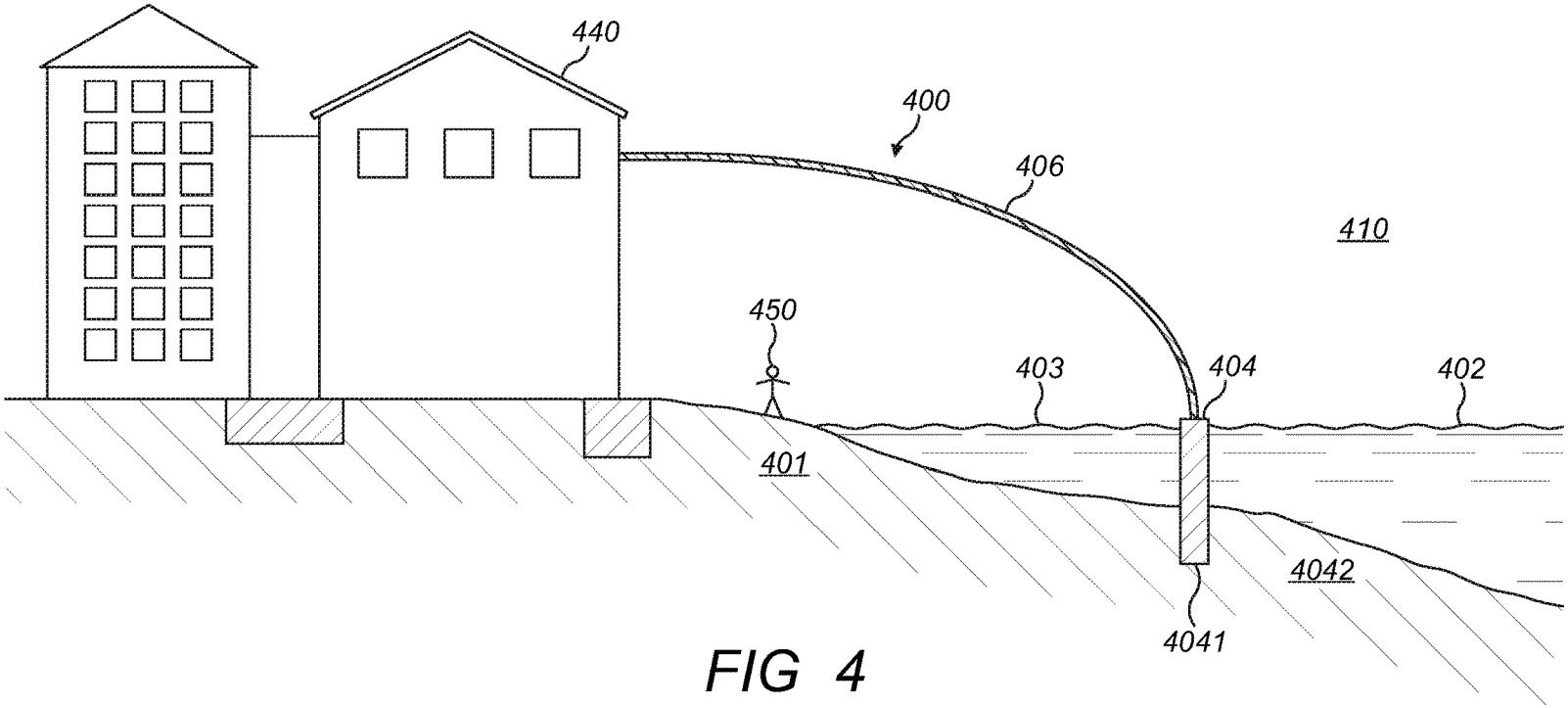
FIG. 4 shows a fourth example of an enclosure according to the invention.

FIG. 4 shows and enclosure 400, which in this instance has been constructed as an extension to a building 440. The land mass 401 therefore comprises a building 440 which can provide accommodation for users of the enclosure 400. The roof 406 of the enclosure extends from the building 400 to the wall 404, which as before is mounted upon a foundation 4041 in the bed 4042 of the body of water 402. The building 440, may be a hotel or other general accommodation block so that users of the enclosure 406 can sleep, dine or generally reside in the building 440, until such time as they wish to make use of the covered controlled ambient environment in the enclosure 406, and also enjoy the enclosed portion 403 of the body of water 402 in a temperature controlled manner. A user 450 can therefore enjoy the experience of stepping outside of their accommodation building 440 without necessarily being exposed to the potentially sub-optimal external environment 410 outside of the enclosure 406. A user 450 can also enjoy the experience of relaxing next to the body of water 402 or entering the body of water in ideal controlled conditions all year round. The roof 406 is preferably substantially curved, and is transparent as in all of the other embodiments, and therefore provides a minimal visual obstruction to the scenery surrounding the body of water 402 and the land mass 401.

Figure 5:
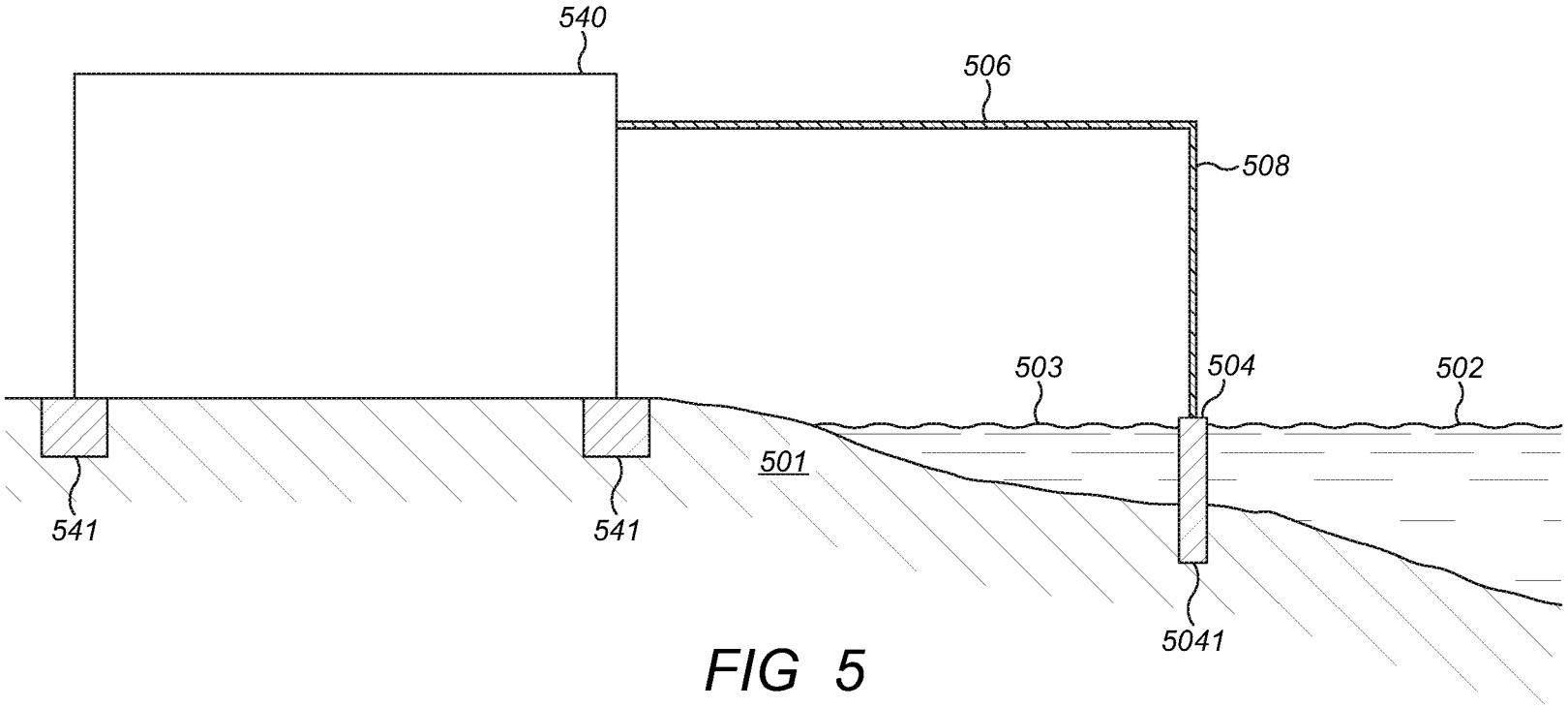
FIG. 5 shows a fifth example of an enclosure according to the present invention.

FIG. 5 shows an alternative arrangement, where the building 540 has a different form to that of the building shown in FIG. 4, having a generally rectangular form, which can be more economical to build. It is built upon foundations 542 and 541, which provide a first portion of the support for roof 506, while the remaining support is provided via foundation 5041, on which a wall 504 separating the enclosed portion 503 from the body of water 502 is provided.

Figure 6:
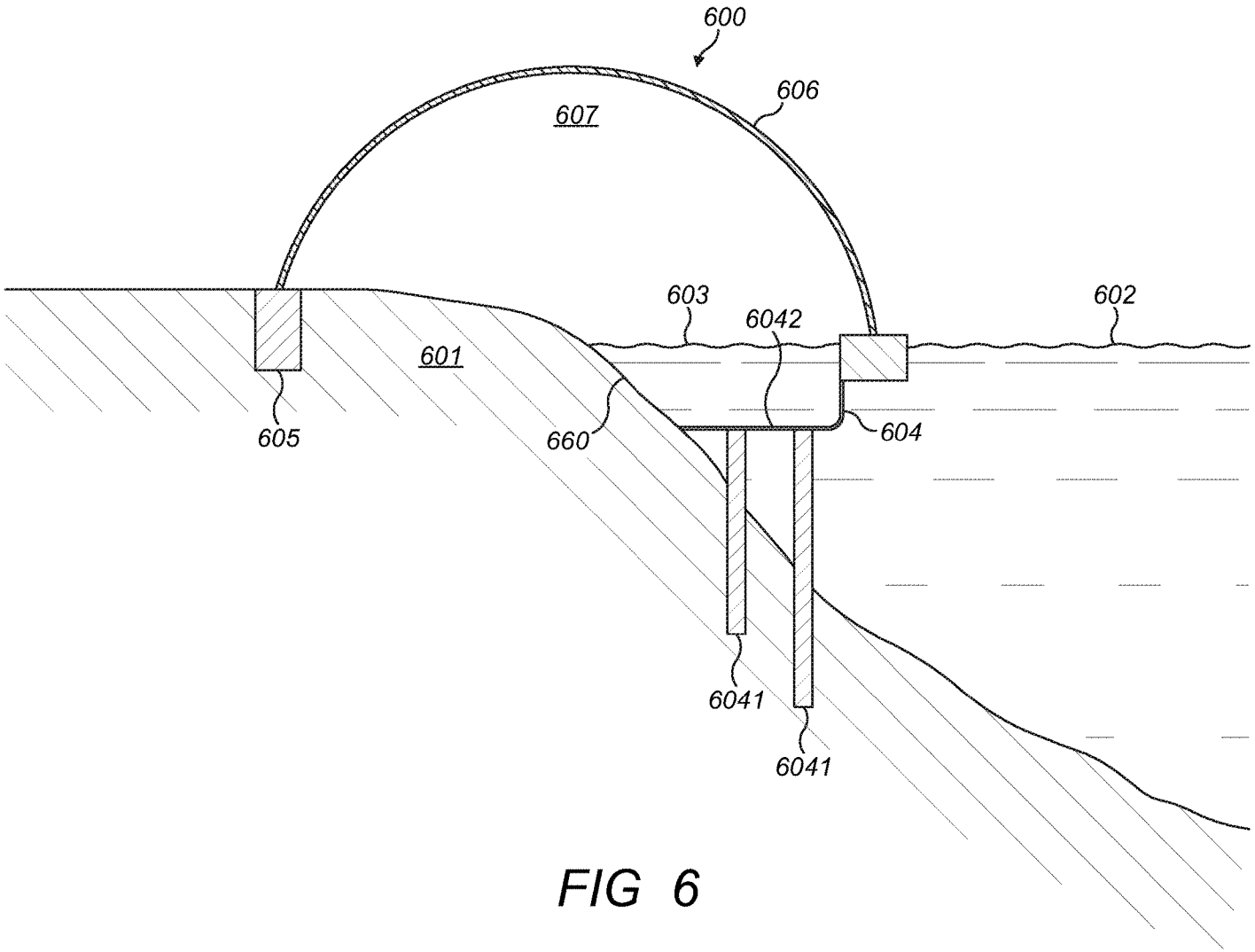
FIG. 6 shows a sixth example of an enclosure according to the invention.

FIG. 6 illustrates a further alternative arrangement of the enclosure 600 of the invention. In certain cases, the bed 660 defined by the surface of the land mass 601 may descend rapidly and so the bed 660 of the enclosed portion 603 of the body of water 602 would normally descend rapidly to a significant depth. It may only be necessary to provide an enclosed portion 603 of the body of water 602 to a certain depth. For example, it may only need to be around 2 meters deep to allow users of the enclosure 606 to swim in the enclosed portion 603. Therefore, to provide an enclosed portion 603 of sufficient area, without having to provide water treatment to an excessively large volume of water, it is possible to provide an enclosure for the enclosed portion 603 which comprises a bottom portion 6042 which projects from the bed 660, preferably at a substantially horizontal orientation, and extends to wall 604. The bottom portion 6042 can be supported on foundations 6041 which may be foundation piles provided in the bed 660 in the body of water 602. In this way, a suspended enclosure is provided for the enclosed portion of the body water 603. This can provide a large surface area of water, and thus a large usable space, to the enclosed portion 603 without necessarily requiring treatment of such a large volume of water as would have to be treated if the enclosed portion 603 extended to the full depth of the overall body of water 602.

The ideal temperature of the ambient air of the enclosure is fully independent from the temperature outside of the enclosure and can be adjusted to meet the comfort of the persons inside of the enclosure.

A range of leisure facilities can be provided within the enclosure, including accommodation such as a hotel 440, catering facilities 308, such as restaurants, canteens, water sports facilities such as a canoe or boat hire station, facilities for snorkeling or scuba diving 209, bars, seating 210, stages and other general entertainment facilities which are usually provided in an outdoor environment. However, in the enclosure of the invention they are enclosed within a controlled environment to give users of the facilities the impression of enjoying an outdoor environment, but in a controlled environment.

These facilities, being protected in the controlled environment of the enclosure, are also not subject to general outdoor weather conditions and so will be less subject to weathering and general wear and tear from the ambient environment outside the enclosure.

Figure 7A:
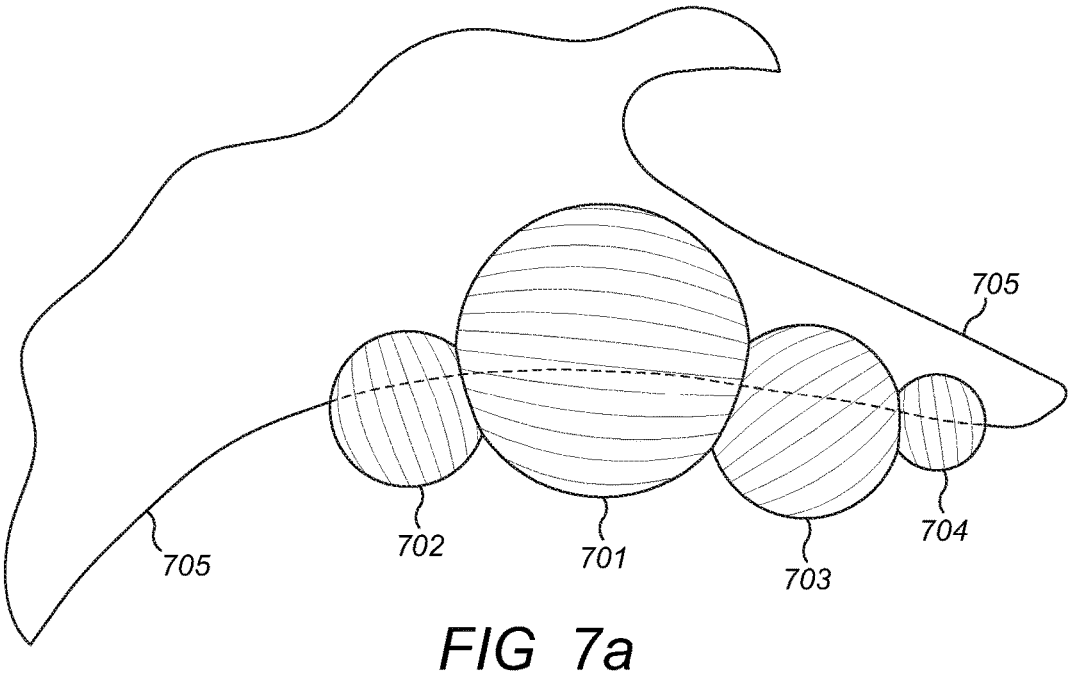
FIGS. 7*a* and 7*b* show a further embodiment of an enclosure according to the invention.
Figure 7B:
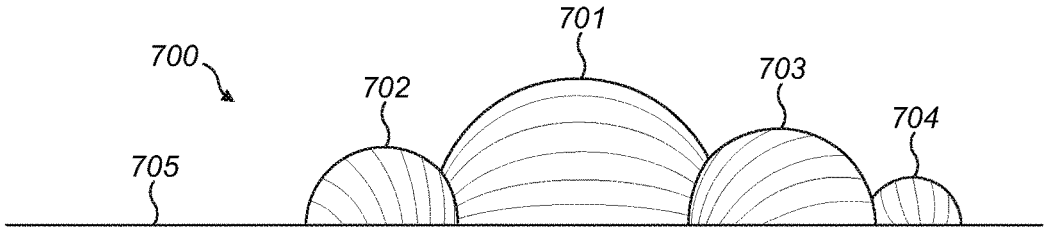

FIGS. 7*a* and 7*b* show a further embodiment of an enclosure according to the invention. The enclosure comprises a plurality of sub-sections 701, 702, 703, 704. The sub-sections are preferably each arranged to straddle at least a portion of the shore line 705. As such, each sub-section can enclose a portion of the land mass to a first side of the shore line 705 and a portion of the body of water to a second side of the shore line 705. The sub-sections may be configured to provide any of the different functions as described above and as such each sub-section may provide a different one of any of those functions. A first enclosure sub-section may be configured for entertainment. A second enclosure sub-section may be configured for catering or restauration, a further enclosure sub-section may be configured for controlled entry or access in order to limit its use. These functions may be combined in one or more sub-sections. To provide different functions, different environmental conditions may be required in each sub-section and so the temperature and/or humidity of each enclosure sub-section may be separately controlled from that of other enclosure sub-sections. Conditions of the water in the enclosure and/or in one or more enclosure sub-sections may also be controlled independently, such as temperature, salinity, purity, or other properties of the enclosed body of water in the sub-section.

It will be apparent to the skilled reader, in light of the disclosure provided herein, that the features of the separate alternative embodiments as described herein can be combined in any combination to arrive at alternative embodiments of the invention which all fall within the scope of the claims of this application.

Although the invention has been described above with reference to one or more preferred embodiments, it will be appreciated that various changes or modifications may be made without departing from the scope of the invention as defined in the appended claims.

The invention claimed is:

1. A waterside leisure facility comprising:

an enclosure, covering and surrounding:

an area of land mass sized to accommodate a group of users of the facility;

an enclosed portion of a body of water, the enclosed portion sized to accommodate a group of users of the facility;

the land mass having a shore front adjoined to the portion of the body of water;

the enclosure further comprising:

a dividing wall arranged to separate and prevent flow of water between the enclosed portion of water and the remaining portion of the body of water;

a transparent roof, joined to the dividing wall and surrounding the area of land mass, to substantially separate air in the enclosure from ambient air outside the enclosure, while letting light through the roof;

a water treatment system arranged to actively maintain the water in the enclosure at a controlled temperature by controlling delivery and release of water, which has been treated, and which has been either heated or cooled to a controlled temperature, into the enclosed portion of the body of water; and an air conditioning system arranged to maintain the ambient air inside the enclosure at a controlled temperature and humidity.

2. A waterside leisure facility according to claim 1, further comprising wave control means for controlling the wave state of the water in the enclosure.

3. A waterside leisure facility according to claim 1, further comprising wind control means for actively controlling wind conditions in the enclosure.

4. A waterside leisure facility according to claim 1, wherein at least a part of the roof comprises transparency control means for controlling the transparency of the roof.

5. A waterside leisure facility according to claim 1, comprising an accommodation block comprising accommodation for a group of users.

6. A waterside leisure facility according to claim 1, wherein the dividing wall comprises at least a portion of the water treatment system.

7. A waterside leisure facility according to claim 1, wherein the roof is supported at a land side by a foundation provided in the land mass.

8. A waterside leisure facility according to claim 7, wherein the foundation at the land side is a foundation of a building.

9. A waterside leisure facility according to claim 7, wherein the foundation at the water side is a foundation for the dividing wall.

10. A waterside leisure facility according to claim 1, wherein the enclosed portion of water is enclosed by a bottom wall portion which extends from a bed of the body of water to the dividing wall to provide an enclosed portion of water of controlled depth.

11. A waterside leisure facility according to claim 10, wherein one or more of the bottom wall portion and the dividing wall is supported by one or more foundations embedded in the bed of the body of water.

12. A waterside leisure facility according to claim 10, wherein the bottom wall portion comprises at least one compliant portion configured to keep the water in the enclosed portion isolated from the body of water.

13. A waterside leisure facility according to claim 10, wherein the bottom wall portion comprises thermally insulating material to prevent heat transfer between the remaining portion of the body of water and the enclosed portion.

14. A waterside leisure facility according to claim 1, wherein the dividing wall comprises at least one compliant portion configured to keep the water in the enclosed portion isolated from the body of water.

15. A waterside leisure facility according to claim 1, wherein the dividing wall comprises thermally insulating material to prevent heat transfer between the remaining portion of the body of water and the enclosed portion.

16. A waterside leisure facility according to claim 1, wherein the enclosure encloses one or more of: an accommodation unit for providing accommodation to a number of users; a catering facility for providing catering to a number of users.

17. A waterside leisure facility according to claim 1, comprising a plurality of adjoining sub-sections, each sub-section comprising one of the enclosure.

18. A waterside leisure facility according to claim 17, wherein the sub-sections have different sizes from one another, or different dimensions from one another, or different sizes and dimensions from one another, for providing different or same user functions.

19. A waterside leisure facility according to claim 18, wherein one or more of the sub-sections is configured to have a different controlled environmental condition from a further sub-section of the enclosure.

20. A waterside leisure facility according to claim 19, wherein the environmental condition is one or more of: a temperature of the water, a temperature of air, a humidity of the air, or a temperature and humidity of the air, in the enclosure subsection.

21. A waterside leisure facility according to claim 1, wherein the dividing wall creates a permanent separation between the enclosed portion of the body of water and the remaining portion of the body of water.

22. A waterside leisure facility according to claim 1, wherein the treated water delivered by the water treatment system mixes with the water of the enclosed portion of the body of water.

23. A waterside leisure facility according to claim 1, wherein the air conditioning system is arranged to actively maintain the ambient air inside the enclosure at the controlled temperature and humidity by controlling delivery and release of air into the enclosure which has been conditioned to a controlled humidity and either heated or cooled.

* * * * *